US005860221A

United States Patent [19]

Morrison et al.

[11] Patent Number: 5,860,221

[45] Date of Patent: Jan. 19, 1999

[54] METERING GRAIN UNLOADER

[75] Inventors: David Wayne Morrison, Macoupin; Eugene B. Pollock, Christian, both of Ill.

[73] Assignee: The GSI Group, Inc., Assumption, Ill.

[21] Appl. No.: 733,614

[22] Filed: Oct. 17, 1996

Related U.S. Application Data

[63] Continuation-in-part of Ser. No. 372,234, Jan. 13, 1995, Pat. No. 5,566,470.

[51] Int. Cl.[6] ..... F26B 19/00

[52] U.S. Cl. ..... 34/64; 34/167; 34/169; 34/233

[58] Field of Search ..... 34/64, 65, 86, 34/167, 168, 169, 170, 233; 454/182

[56] References Cited

U.S. PATENT DOCUMENTS

| | | | |
|---|---|---|---|
| 746,410 | 12/1903 | Turner | 222/328 |
| 3,333,348 | 8/1967 | Ausherman | 34/174 |
| 3,710,449 | 1/1973 | Rathbun | 34/65 |
| 3,755,917 | 9/1973 | Lambert, Jr. | 34/179 |
| 3,766,664 | 10/1973 | Burgin | 34/182 |
| 3,864,845 | 2/1975 | Cooper | 34/171 |
| 3,896,562 | 7/1975 | Zimmerman | 34/174 |
| 3,955,288 | 5/1976 | Keirn | 34/174 |
| 4,004,351 | 1/1977 | Sanneman et al. | 34/174 |
| 4,398,356 | 8/1983 | Westelaken | 34/65 |
| 4,423,557 | 1/1984 | Westelaken | 34/573 |
| 4,914,834 | 4/1990 | Sime | 34/169 |
| 5,020,246 | 6/1991 | Rust et al. | 34/236 |
| 5,129,164 | 7/1992 | Painter et al. | 34/181 |
| 5,136,791 | 8/1992 | Fraifle et al. | 34/586 |
| 5,566,470 | 10/1996 | Morrison | 34/167 |

OTHER PUBLICATIONS

Copy of 4 page brochure on Model RAB–5000 Recirculating Automatic Batch Dryer ©1987.

*Primary Examiner*—Henry A. Bennett
*Assistant Examiner*—Steve Gravini
*Attorney, Agent, or Firm*—Polster, Lieder, Woodruff & Lucchesi

[57] ABSTRACT

A metering unloader (101) for unloading a fluent material from a flow path (11) is disclosed. The flow path has a fluent material outlet (27). The metering unloader comprises an unloader body (103) having an outer cylindric wall (105) and an inner cylindric wall (107) spaced radially inwardly from the outer wall with the walls defining a chamber (126) therebetween. Means (117) is provided for rotating the unloader body about a vertical axis. Outer wall (105) has a fluent material inlet opening (119) such that with the fluent material inlet opening (119) in register with the flow path fluent material outlet (27), the fluent material will flow by gravity through the fluent material inlet opening (119) in the outer wall into the chamber (126). The inner wall (107) has a fluent material outlet opening (127) therein such that the fluent material in the chamber (126) will flow by gravity from the chamber to a fluent material discharge outlet (15). A gate (121) is mounted relative to the fluent material inlet opening (119) in the outer wall, and means (123) is provided for opening and closing the gate (119) thereby to regulate the flow of fluent material into the chamber (126) from the fluent material outlet (27) when the fluent material inlet opening (119) is in register therewith and to vary the rate at which the unloader (101) unloads the fluent material from the flow path.

14 Claims, 9 Drawing Sheets

METERING GRAIN UNLOADER

CROSS-REFERENCE TO RELATED APPLICATIONS

This is a continuation-in-part application based on U.S. patent application Ser. No. 08/372,234 filed Jan. 13, 1995, now U.S. Pat. No. 5,566,470, issued Oct. 22, 1996.

STATEMENT REGARDING FEDERALLY SPONSORED RESEARCH OR DEVELOPMENT

Not applicable.

BACKGROUND OF THE INVENTION

This invention relates to an unloader for a tower grain dryer or the like, and more particularly to such an unloader which meters or positively unloads the dried grain from such a dryer in such manner that dried grain is substantially uniformly removed from all regions of the dryer outlet section.

Tower grain dryers are well known. Generally, they comprise a vertical tower of cylindrical or other shape. The tower has a plenum located within the tower and spaced from the inner surfaces of the outer walls of the tower. Typically, the walls of the tower and of the plenum are of porous construction such that air from within the plenum may be forced through the walls. Grain to be dried is conveyed to the upper reaches of the tower and fills the space between the outer tower wall and the plenum so as to form a drying path for the grain to be dried. As dried grain is continuously discharged from the lower end of the grain drying path, additional grain to be dried is loaded into the upper end of the drying path.

The plenum is supplied with heated air by means of one or more burner/blower assemblies. The heated air is forced from within the plenum through the porous or perforated walls of the plenum, through the grain in the drying path, and is forced through the porous outer wall of the tower carrying away moisture from the grain.

Reference may be made to the following U.S. Pat. Nos. which describe tower or other similar types of grain dryers of the type discussed above: 746,410, 3,333,348, 3,710,449, 3,766,664, 3,864,845, 3,896,562, 3,955,288, 4,004,351, 4,398,356, 4,423,557, 4,914,834, 5,129,164, and 5,136,791.

In certain of these prior art tower grain dryers, the lower portion of the drying path converges inwardly of the tower in a generally conical shape and is divided into a number of separate converging channels. The lower ends of the channels discharge the dried grain into the bottom of the tower to be unloaded. Unloading can be accomplished in a variety of ways. Of course, grain being a fluent material may flow by gravity out through gravity outlets. Alternatively, the grain may be swept from the base of the tower by a sweep auger or the like and conveyed by the sweep auger to a discharge outlet, as described in the above-noted U.S. Pat. No. 3,896,562. Still further, discharge augers may be located directly below the grain drying paths, as shown in U.S. Pat. No. 3,864,845, to unload the dried grain. In U.S. Pat. No. 3,333,348, a grain drying apparatus is disclosed having an inner wall and a spaced outer wall defining a grain flow path and having a pair of rotary agitator arms which extend out from the center of the dryer. In U.S. Pat. No. 4,004,351 uses rotary driven scoop arms to positively remove grain from the grain flow path.

However, it has been found that with tower dryers in which the grain drying path converges inwardly at the bottom of the tower and in which the grain drying path is divided into a number of converging channels, dried grain is oftentimes not uniformly removed from all of the channels. It has been found that grain will be removed at faster rates from some of the channels than from others. Because the speed at which the grain moves through the drying path (and hence the amount of time the grain is exposed to the drying air) varies in direct relation to the rate at which the dried grain is removed from the outlets of the channels, prior grain unloaders which did not uniformly remove dried grain from all of the grain channels caused some of the grain to move too fast through the dryer such that this faster moving grain might not be sufficiently dried, while other grain in the drying path might move too slowly such that this slower moving grain might become over dried. Of course, under dried grain is not desirable because it could lead to spoilage of the grain, and over dried grain is not desirable because it might become damaged from excessive exposure to the heated air which would waste energy and may damage the grain.

In the grain dryer described in the parent application of the present invention, now U.S. Pat. No. 5,566,470, dried grain is removed from the grain flow path by a rotary driven metering unloader body rotatably driven about a vertical axis and having a vertical wall for blocking the flow of grain from the grain flow path with the unloader wall having a grain inlet opening such that grain may enter the unloader body only by way of the grain inlet opening. Upon rotation of the unloader body, the grain within the unloader body is conveyed toward a center grain discharge outlet opening for removal from the dryer. While this unloader works well for its intended purpose, in order for it to vary the rate at which dried grain is unloaded, the rotary speed at which the unloader body is driven must be varied. This requires the use of a variable speed drive which is costly. In addition, the earlier metering unloader of this invention required a sweeping action to move the grain across the horizontal floor of the unloader to the grain discharge outlet. Therefore, there has been a need for a metering unloader body which does not require the use of variable speed drive and which does not require a sweeping action to discharge the grain.

BRIEF SUMMARY OF THE INVENTION

Among the several object of the present invention may be noted the provision of a metering unloader installed in the lower reaches of a tower grain dryer for substantially uniformly unloading dried grain from all regions of the outlet portion of the dryer;

The provision of such an unloader in which the drying path of the tower dryer terminates in a number of side-by-side converging channels and in which the dried grain discharged from these channels is substantially uniformly unloaded from all of the channels;

The provision of an unloader which insures that the rate in which the speed of the grain moving through the drying flow path is substantially uniform;

The provision of such an unloader which positively meters the grain from each region of the grain drying path so as to insure that all of the grain moving through all regions of the grain drying path moves at substantially the same speed and thus is uniformly dried;

The provision of such an unloader in which the rate at which grain may be unloader from the dryer can be regulated;

The provision of such an unloader which does not require the use of a variable speed drive to vary the rate at which grain is removed from the grain dryer; and The provision of such an unloader which is free of jams, is of simple and rugged construction, and which is of economical construction.

Other objects and features of this invention will be in part apparent and in part pointed out hereinafter.

Briefly stated, a metering unloader of the present invention is intended for use in a tower grain dryer. The later comprises a vertical tower having a plenum therein. The plenum has a plenum wall. The tower has an outer wall surrounding the plenum wall with the tower outer wall being spaced outwardly from the plenum for forming a grain drying path between the tower outer wall and the plenum wall. The grain to be dried is conveyed through the grain drying path generally from the top to the bottom of the dryer. The outer wall of the tower and the plenum wall are porous to permit air to flow therethrough. The tower dryer has means for moving air into the plenum, through the plenum wall, through the grain in the grain drying path thereby to dry the grain, and through the tower wall to exhaust the air to the atmosphere on the exterior of the outer tower wall. The grain drying path has a grain outlet at the lower end thereof. The tower has at least one discharge outlet in the lower portion thereof. The metering unloader is rotatably mounted within the lower portion of the tower for rotation about a vertical axis. Means is provided for rotatably driving the metering unloader about the vertical axis. The metering unloader is in communication with the grain outlet of the grain drying path for substantially uniformly removing dried grain from all regions of the lower portion of the tower upon each revolution of the metering unloader and for the delivery of such dried grain to the at least one discharge outlet.

The method of the present invention relates to substantially uniformly unloading dried grain from a tower grain dryer. The tower dryer has a plenum therewithin with the walls of the plenum being porous, an outer tower wall surrounding the plenum and defining a grain drying path therebetween. The outer tower wall is porous. Means is provided for forcing heated air into the plenum, through the plenum walls, through the grain in the drying path, and through the outer tower wall. The drying path has an outlet end for the discharge of the dried grain into the lower portion of the tower. The lower portion of the tower has a discharge outlet through which the dried grain may be unloaded from the tower dryer. Specifically, the method of this invention comprises the steps of providing a metering unloader in the lower portion of the tower. The unloader has a grain inlet in communication with the dried grain discharged from the outlet end of the drying path, a discharge end in register with the discharge opening, and a path between the grain inlet and the discharge end. The unloader is rotated about a vertical axis. The dried grain is substantially uniformly scooped from all regions of the outlet end of the drying path as the unloader rotates and is conveyed through the path within the unloader to the discharge outlet.

In another embodiment of this invention, as shown in FIGS. 6–14, relates to a metering unloader (101) for unloading a fluent material from a flow path (11). The flow path has a fluent material outlet (27). The metering unloader comprises an unloader body (103) having an outer cylindric wall (105) and an inner cylindric wall (107) spaced radially inwardly from the outer wall with the walls defining a chamber (126) therebetween. Means (117) is provided for rotating the unloader body about a vertical axis. Outer wall (105) has a fluent material inlet opening (119) such that with the fluent material inlet opening (119) in register with the flow path fluent material outlet (27), the fluent material will flow by gravity through the fluent material inlet opening (119) in the outer wall into the chamber (126). The inner wall (107) has a fluent material outlet opening (127) therein such that the fluent material in the chamber (126) will flow by gravity from the chamber to a fluent material discharge outlet (15). A gate (121) is mounted relative to the fluent material inlet opening (119) in the outer wall, and means (123) is provided for opening and closing the gate (119) thereby to regulate the flow of fluent material into the chamber (126) from the fluent material outlet (27) when the fluent material inlet opening (119) is in register therewith and to vary the rate at which the unloader (101) unloads the fluent material from the flow path.

In still another embodiment of this invention, a metering unloader (29, 101) for unloading a fluent material from a flow path (11) is disclosed. The flow path has a fluent material outlet (27). The metering unloader comprises an unloader body (37, 103) having an outer cylindric wall (49, 105) and an inner cylindric wall (52,107) spaced radially inwardly from the outer wall with the walls defining a chamber (55, 126) therebetween. Means (41, 117) is provided for rotating the unloader body about a vertical axis. A fluent material inlet opening (51,119) is provided in the outer wall (49, 105) such that with the fluent material inlet opening (51, 119) in register with the flow path fluent material outlet (27), fluent material will flow by gravity through the fluent material inlet opening in the outer wall into the chamber (55, 126), the inner wall (52, 107) having a fluent material outlet opening (56, 127) therein such that the fluent material in the chamber (55, 126) may flow by gravity from the chamber to a fluent material discharge outlet (15), and means for regulating the rate at which grain is uniformly metered from each of the fluent material outlets (27) thereby to discharge a desired volume of the fluent material in a given length of time.

BRIEF DESCRIPTION OF THE SEVERAL VIEWS OF THE DRAWINGS

Corresponding reference characters represent corresponding parts throughout the various views of the drawings.

DETAILED DESCRIPTION OF THE INVENTION

Figure 1:
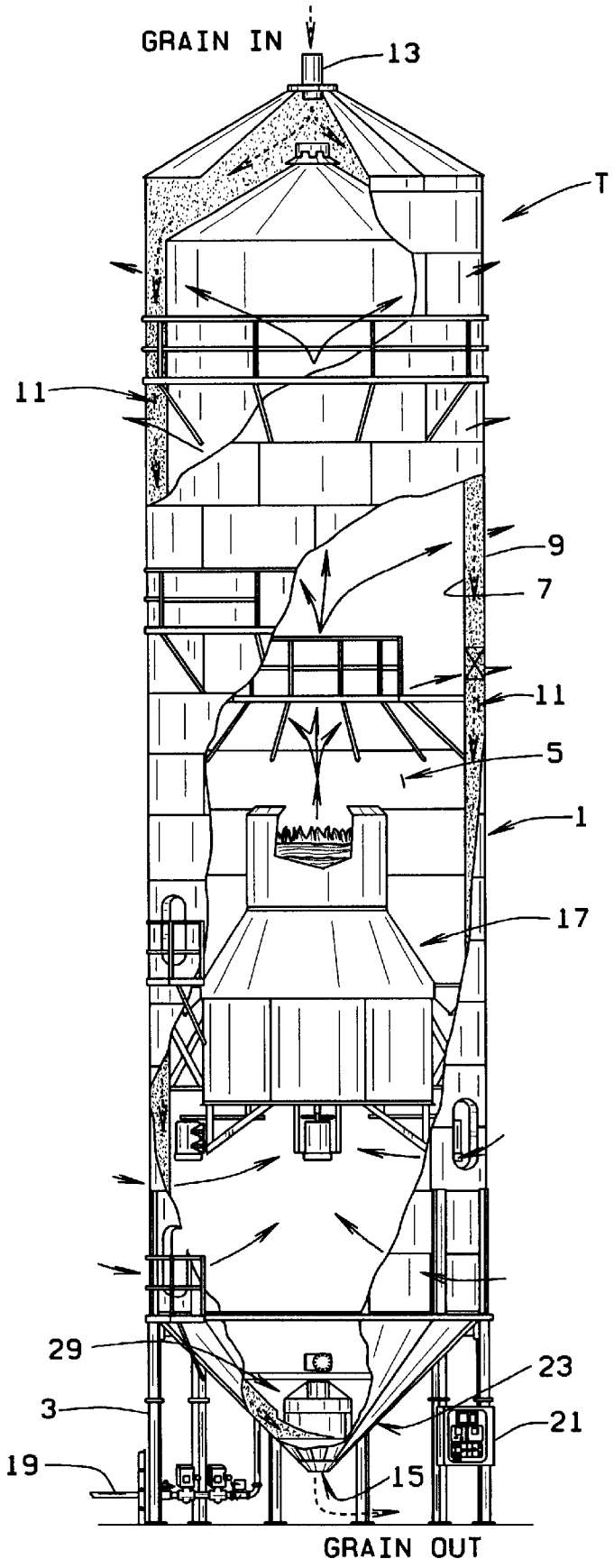
FIG. 1 is an elevational view (with portions broken away) of a tower grain dryer having a metering unloader of the present invention therein.

Referring now to the drawings, and more particularly to FIG. 1, a tower dryer T is shown in partial cross section. More specifically, tower dryer T comprises a vertical grain drying tower 1 which may, for example, be fifty feet or more in height. The tower has a base 3 of suitable structural steel members mounted in a suitable foundation (not shown). A plenum 5 is disposed within the grain dryer. The plenum is defined by a generally cylindrical porous plenum wall 7. Tower 1 has an outer cylindrical tower wall 9 of porous construction surrounding plenum wall 7 and spaced outwardly therefrom so as to define a vertical, annular grain drying path 11. Grain may be supplied to grain drying path 11 by means of a grain inlet 13 at the top of tower 1 and dried grain may be discharged from the tower dryer by means of a grain discharge outlet 15 at the lower end of the dryer.

As generally indicated at 17, a heater/blower assembly is provided within the grain dryer for drawing ambient air through the grain path 11 in the lower reaches of the tower and, if demanded, for heating the air, and for discharging the heated air under pressure into plenum 5. In this manner, the air discharged from heater/blower 17 is distributed substantially uniformly within the plenum and is forced to flow through the porous plenum wall 7, through the grain in grain drying path 11, so as to be exhausted through the porous outer walls tower 9 to the atmosphere thereby carrying moisture from the grain to the atmosphere. Whole heater/blower 17 is shown in FIG. 1 to be located within tower 1, it will be understood that within the broader aspects of this invention that the heater/blower may be located outside the tower in close proximity thereto and air from the heater/blower may be ducted into plenum 5.

Typically, fuel for heater/blower assembly 17 is supplied by gas fuel supply lines 19 and operation of the heater/blower assembly and overall operation of tower dryer T is controlled by a computer control housed in a control panel 21. Computer control is preferably of the type disclosed in the co-assigned U.S. patent application Ser. No. 08/193,710 filed Feb. 9, 1994 which is incorporated by reference herein, but reprogrammed to operate with tower dryer T rather than with the continues flow of grain dryers disclosed in the above noted patent application.

Figure 2:
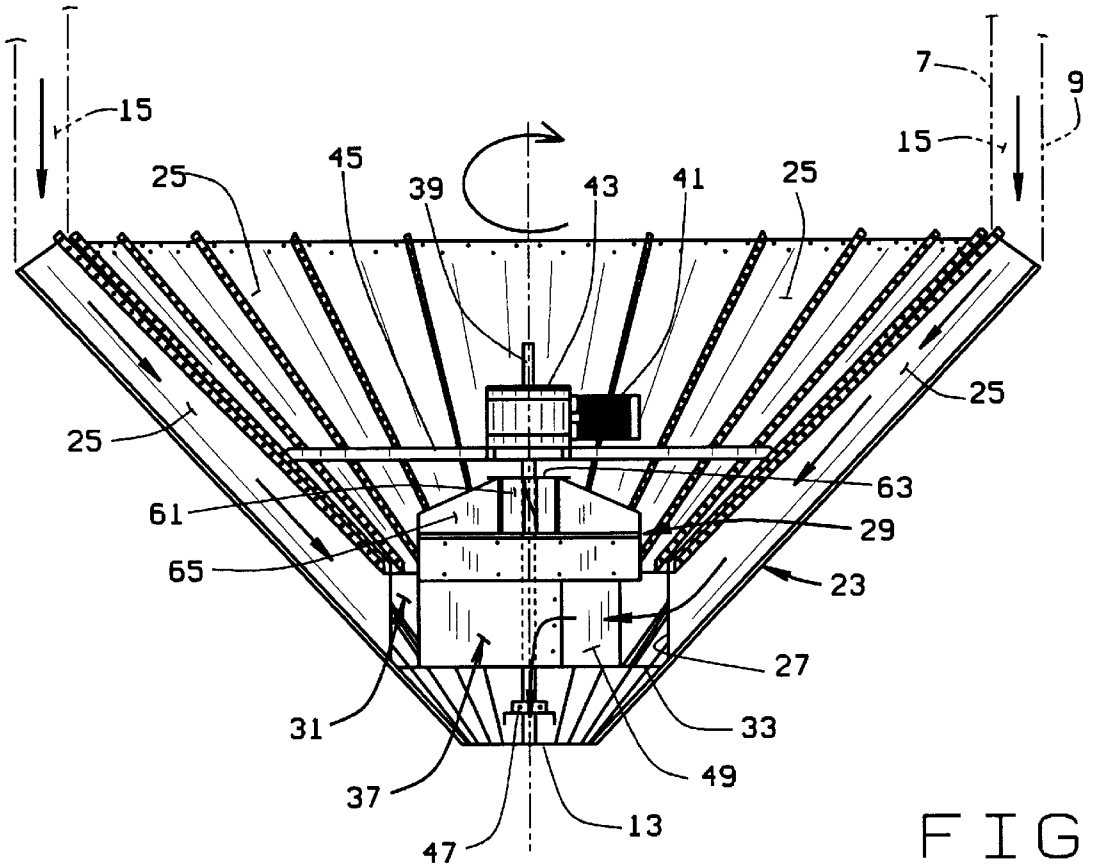
FIG. 2 is an enlarged cross sectional view of the lower portion of the tower dryer shown in FIG. 1 illustrating converging grain channel which direct the dried grain downwardly toward a metering unloader of the present invention.

As shown in FIG. 1, tower 1 has a converging conical hopper bottom 23. As shown in FIG. 2, hopper bottom 23 receives grain from grain drying path 11 and the portion of drying path in hopper bottom 23 is divided into a plurality of converging grain flow channels 25 leading downwardly at the slope of the hopper bottom from the lower cylindrical reaches of the drying path in tower 1. Each of the converging grain channels 25 has a respective grain outlet opening 27 at its lower end for the discharge dried grain from the drying path 11.

Figure 3:
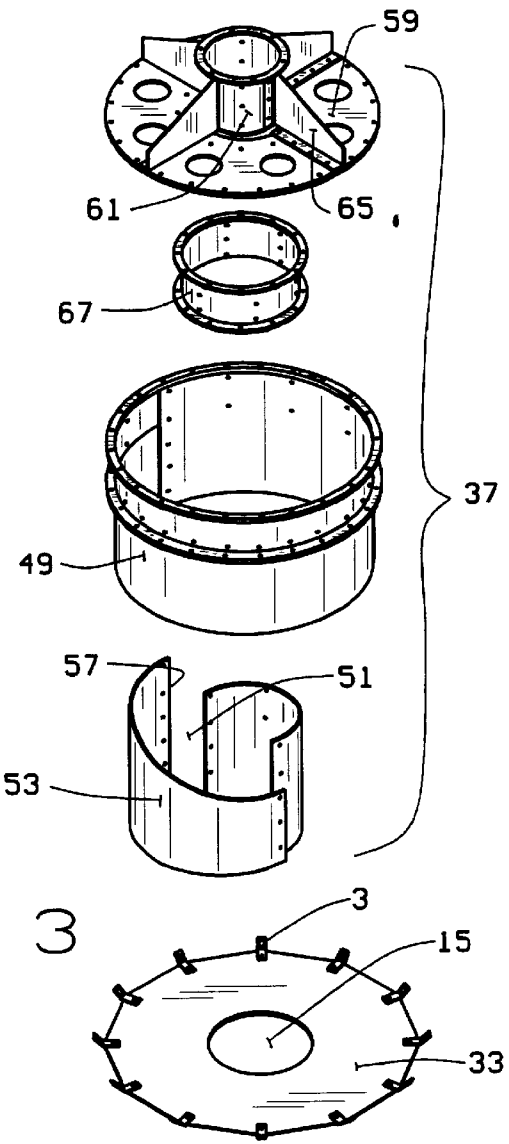
FIG. 3 is an exploded perspective view of the major components of the metering unloader body.

As generally indicated at 29, a metering grain unloader of the present invention is provided in the lower reaches of hopper bottom 23 for receiving grain discharged from grain outlet openings 27 for positive, metered unloading of the dried grain from each of the outlet openings 27, and for conveying this dried grain to grain discharge outlet 15 such that dried grain is substantially uniformly unloaded from all of the grain channels 25. Metering grain unloader 29 is somewhat smaller in diameter than the diameter of the lower end of hopper bottom 23 at the height of grain outlet openings 27 so as to form an annular grain channel 31 interposed between the grain outlet openings 27 and the body of metering grain unloader 31. The lower end of hopper bottom 23 is closed off by a generally horizontal bottom wall 33. As shown in FIG. 3, bottom wall 33 has grain discharge opening 15 at the center thereof. The bottom wall is provided with a plurality of attachment tabs 35 which allow the bottom wall to be bolted to the inner surface of the conical hopper bottom 23.

In accordance with this invention, metering grain unloader 29 is mounted within hopper bottom 23 for rotation about a vertical axis for positively gathering grain from within annular grain channel 31 and for positively discharging the dried grain through grain discharge opening 15 in bottom wall 33. More specifically, metering grain unloader 29 comprises an unloader body 37 secured to a vertical shaft 39. Shaft 39 is rotated by a variable speed drive motor 41 having a speed gear reducer 43. The motor and speed reducer are mounted on a motor frame 45 secured to the inner walls of hopper bottom 23 above unloader body 37. The lower end of vertical shaft 39 is journalled in a lower bearing 47 located below opening 15 in bottom wall 33.

More specifically, unloader body 37 has an outer cylindrical body wall 49 defining the inner surface of annular grain channel 31. This vertical cylindrical wall 49 extends upwardly from bottom wall 33. Cylindrical wall 49 has a grain inlet opening 51 therein. Unloader body 37 further has a spiral wall 53 mounted within cylindrical body wall 49 extending up from bottom wall 33 and defining a spiral shaped grain unloading path 55 (see FIG. 5) within the unloader body. Spiral wall 53 has a leading edge 57 which also constitutes the leading edge of grain inlet opening 51. The spiral wall extends from opening 51 in a spiral fashion into the central portion of the unloader with the inner portion 52 of the spiral wall serving an the inner wall of the unloader. The inner or trailing edge of the spiral wall forms a grain outlet opening, as indicated at 56 (see FIG. 5). Of course, the grain discharged from grain outlet opening 54 falls by gravity to grain discharge 15. In this manner, as metering grain unloader 29 is rotated in clockwise direction (when viewed from above) with vertical shaft 39, grain inlet opening 51 rotates around the inner surface of annular grain channel 31 thereby to uniformly pick up grain discharged from each grain outlet opening 27 from each of the tapered grain channels 25. Rotary motion of the metering grain unloader causes the grain to flow within grain unloading path 55 from grain inlet opening 51 to grain outlet opening 56 in a generally horizontal manner and the grain is discharged to fall into grain discharge opening 15 in bottom wall 33 and thence to be discharged from tower dryer T in to a suitable grain unloading auger or the like (not shown).

Metering unloader body 37 further comprises a cover plate 59 secured to the upper surface of cylindrical wall 49. A hub 61 is carried on the upper surface of cover plate 59. A hub cover plate 63 is secured to the upper face of hub 61. The hub cover plate in turn in secured to vertical shaft 39. In this manner, metering unloader body 37 is secured to vertical shaft 39 so as to be rotatable therewith. As noted above, the bottom end of shaft 39 is received in bearing 47 such that the weight of the metering body is supported by the drive shaft which in turn is supported by frame 45 and bearing 47. Unloader body 37 is adjusted such that the lower edge of cylinder wall 49 is just clear of floor 33 such that as the metering unloader body is rotated with drive shaft 39, the weight of the metering unloader body does not bear on floor 33. Hub webs 65 stiffen cover plate 59 and help support the cover plate relative to hub 61. An inner cylinder 67 is secured to the bottom of cover plate 59 and the lower rim of the inner cylinder 67 is secured to the upper, inner margins of spiral wall 53 thereby to rigidly support the spiral wall at its center and to securely hold the spiral all in place relative to unloader body 37 and to thus accurately maintain the spiral or involute shape of grain unloading path 55 as the grain unloader 29 rotates with shaft 39.

In operation, grain to be dried is loaded within tower dryer T via grain inlet 11 at the top of the tower. The grain flows down over the conical cap of plenum 5 and is uniformly distributed into the vertical, annular grain drying path 11 and fills the grain drying path from top to bottom. It will be understood that as the grain fills the drying tower it will be initially discharged from outlet openings 27 from grain channels 25 so as to substantially fill annular space 31 and to surround metering unloader body 37. Once the annular space 31 becomes filled with grain to a level somewhat above the tops of grain outlet openings 27, the grain will back up within grain chutes 25. Continued loading of grain into tower 2 will fill the vertical grain drying path 11 with grain.

Once the grain drying path 11 has been filled with grain, as above described, heater/blowers 17 are operated such that heated air is discharged under pressure into plenum 5. The heated air is distributed uniformly within the plenum and is forced through the porous plenum wall 7 into the grain in the grain drying path 11, through the grain to pick up moisture therefrom, and is discharged to the atmosphere via the porous outer tower wall 9 forming the outer surface of the grain drying path.

In order to unload grain from tower dryer T, drive motor 41 is energized so as to rotate vertical shaft 39 and to thus cause unloader body 37 to rotate with the shaft. As noted, annular grain channel 31 surrounding body wall 49 of the unloader body is filled with dried grain discharged from grain outlet openings 27 in grain channels 25 within hopper section 23 of the tower dryer. As the unloader body 37 rotates with vertical shaft 39, the leading edge 57 of grain inlet opening 51 rotates through the grain within annular grain space 31 and positively scoops up grain from the annular grain space and directs the dried grain into grain unloading path 55. Continued turning of unloader body 37 causes the grain within grain unloading path 55 to be conveyed within the grain unloading path from grain inlet 51 to the inner end of the grain unloading path for discharge from the tower dryer via grain discharge outlet 15 located within the bottom wall 33. As noted, a suitable grain discharge auger unloader or the like (not shown) may be provided to convey the dried grain from the tower dryer.

As indicated by the arrows in FIG. 1, ambient air is drawn into tower T through the lower reaches of the outer porous tower wall 9, through the grain which has been heated and dried in the upper reaches of the tower and thence through the porous inner plenum wall 7 for intake into the heater/blower 17. This cooler, ambient air passing through the heated, dried grain tends to cool the grain and to recover heat from the grain so that at least some of the heat is regenerated and is again utilized in the drying process. It will also be appreciated that the heated grain in the lower portion of the grain drying path 11 is substantially free of excess moisture such that the inflow of air to the heater/blower 17 does not carry excessive moisture.

It will be particularly understood that the unloader 29 of the present invention is a metering unloader. That is, upon each revolution of unloader body 37, a given amount of dried grain is picked up by the grain inlet 51 on each revolution of the unloader body in turn from each of the outlets 27 of the grain channels 25. In this manner, it is insured that grain from each of the grain channels 25 will be uniformly unloaded. This overcomes a problem with prior art grain dryers utilizing gravity discharge outlets where grain would be unevenly unloaded from certain of the discharge chutes but would not be as readily unloaded from adjacent chutes. This non-uniform unloading resulted in grain flowing through the drying path 11 at non-uniform rates which resulted in some of the grain possibly becoming overheated and over dried, while other grain that moved through the drying path at a faster rate was under dried.

As noted, motor 41 is a variable speed motor preferably under microprocessor control of control panel 21. By varying the speed at which motor 41 is operated, the rotational speed of unloader body 31 may also be varied thus increasing or decreasing the rate at which grain is unloaded. Of course, as grain is unloaded more quickly, the grain flowing downwardly through the grain drying path 11 will move faster thus increasing the through put and drying capacity of tower dryer T. Those skilled in the art will recognize that by controlling the rate at which unloader body 37 is rotated controls the rate at which grain may be continuously dried by tower T.

By way of example, drive motor 41 may be operated between a very slow speed mode of operation and its normal maximum operating speed such that the motor driving unloader 29 through speed reducer 43 will rotate from a speed slightly more that 0 rpms (revolutions per minute) up to about 30 rpms. However, it has been found that under most operating conditions, the unloader will be rotated between about 10 and 15 rpms. It will be appreciated that with unloader 29 operating between about 10 and 15 rpm, the grain inlet opening 51 in the unloader will move past each of the grain outlets 27 once every 4–6 seconds and remove grain from grain channel 31 thus allowing more grain to flow down each of the grain channels 25 to replace the grain scooped up by the unloader and conveyed from the tower dryer via grain unloading channel 55 in the unloader. This in turn allows the grain in grain drying path 15 to move downwardly at a substantially uniform rate around all regions of the drying path. This insure uniform drying of the grain. Further, by speeding or slowing the rate at which the unloader is rotated, the rate at which the grain moves downwardly (and thus the length of time that the grain in the drying path is exposed to drying air) may be regulated and controlled.

As described above, as grain flowing down grain flow path 11 within tower dryer T exits the bottom of the cylindrical tower, it is directed into a conical hopper 23 which is preferably divided into a plurality of grain flow channels 25 and each grain flow channel has a grain outlet opening 27 disposed on the exterior of unloader 29 such that as unloader 29 rotates, grain inlet opening 51 in wall 49 rotates past and is in register with each of the grain outlet openings 27 on each revolution of the unloader. However, it will be understood that within the broader aspects of this invention, grain channels 25 in hopper section 23 and separate grain outlets 27 are not essential to the operation of the metering unloader of the present invention. It will be understood that the grain outlet for the grain path 11 may be a single outlet which surrounds the unloader. Therefore, the term "one or more grain outlets" encompasses the plurality of grain outlets 27 shown in FIG. 2, or it may encompass a single grain outlet which is not divided into channels and which substantially surrounds the outer cylindric wall 49 of the unloader of this invention.

Referring now to FIGS. 6–14, two additional embodiments of the metering grain unloader of the present invention are shown. A first additional embodiment of the unloader is indicated in its entirety at 101. This other grain metering unloader replaces grain unloader 29 shown in FIGS. 1–5 within tower dryer 1. However, those skilled in the art will recognize that the unloaders shown in FIGS. 1–14 herein have applications in grain moving, drying, storage and conveying systems other than tower dryers.

More specifically, unloader 101 comprises an rotary driven unloader body 103 having an outer cylindric wall 105 spaced radially inwardly of the grain outlet openings 27 of each of the grain flow channels 25 of tower 1 and in inner cylindrical wall 107. The inner and outer cylindrical walls 107 and 105 are mounted on an unloader frame 109 and are rotatably supported by a bottom bearing 111 and by an upper bearing 113 on a vertical shaft 115 for rotating about the vertical axis of shaft 115 by a suitable drive motor 117. Preferably, drive motor 117 is a gearmotor having a built in speed reducer. It will be appreciated that drive motor 117 may be of a fixed or constant drive speed inasmuch as the drive motor speed need not be varied in order to vary the rate of unloading dried grain from tower dryer 1 when using unloader 101. While drive motor 117 is preferred to be a gear motor, it will be recognized that because unloader 101 is driven at constant speed it would be possible to drive the unloader with a belt and pulley drive in place of the above-described gearmotor. Of course, such belt and pulley drive would be even less costly than the constant speed gearmotor drive.

Figure 6:
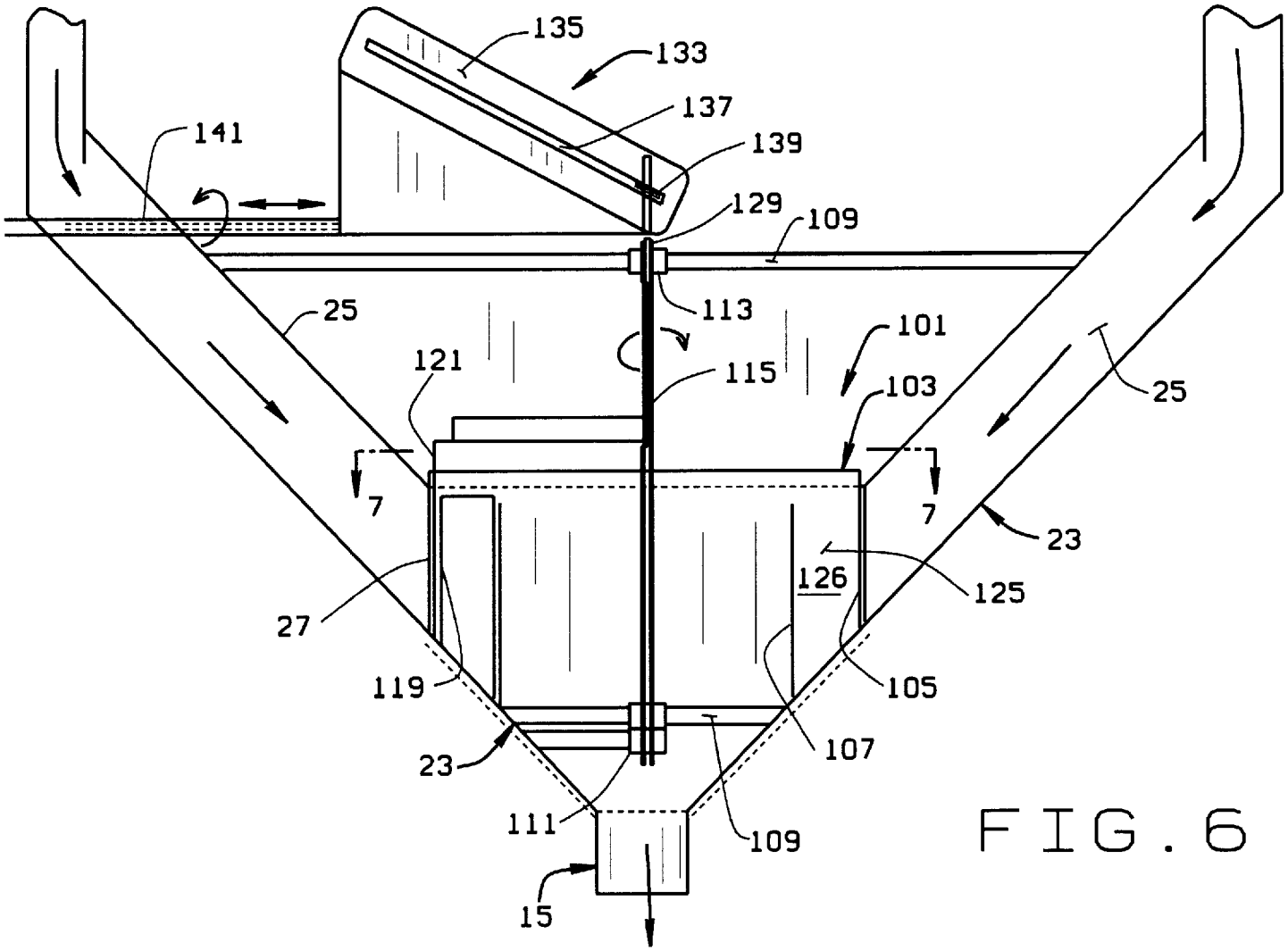
FIG. 6 is a view of the dryer similar to FIG. 2 illustrating another embodiment of the unloader of the present invention.
Figure 7:
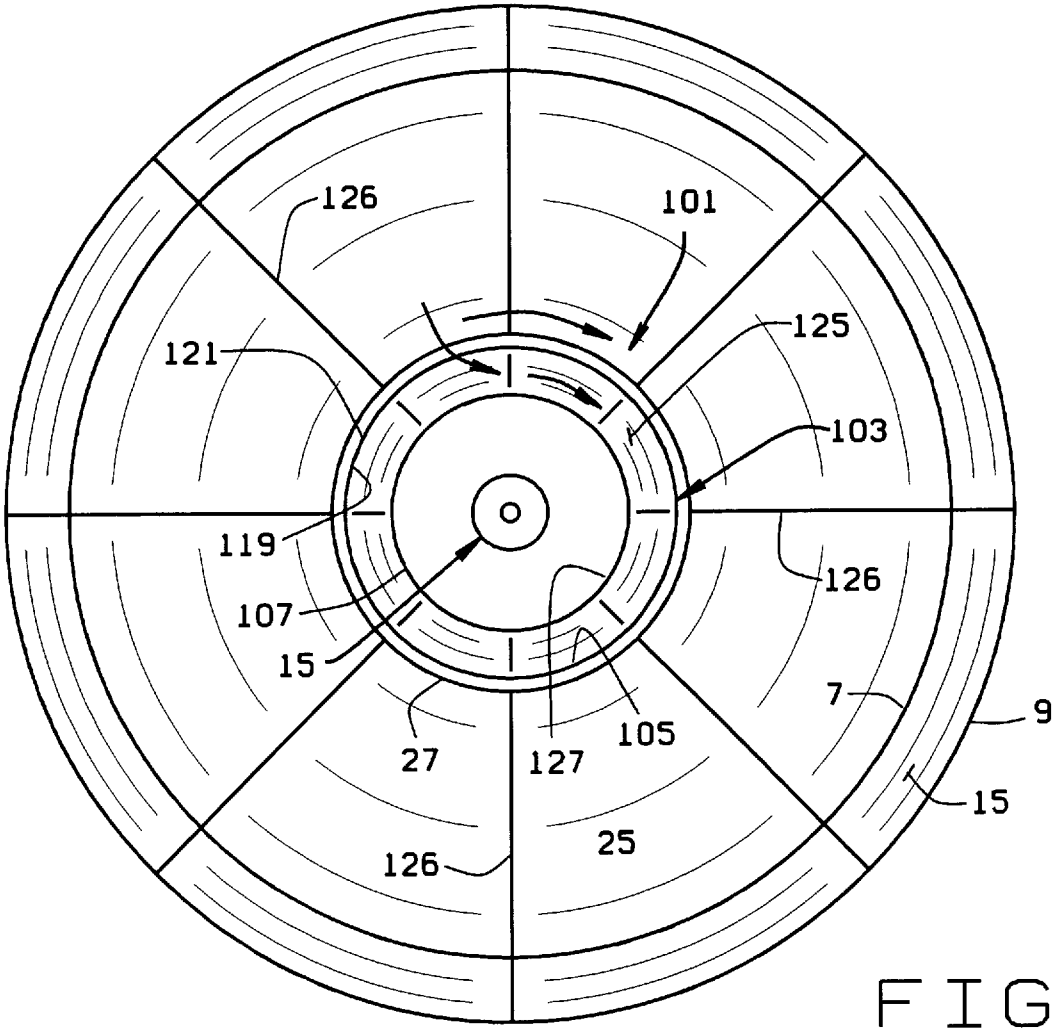
FIG. 7 is a top plan view of the unloader shown in FIG. 6 taken along line 7—7 of FIG. 6.
Figure 8B:
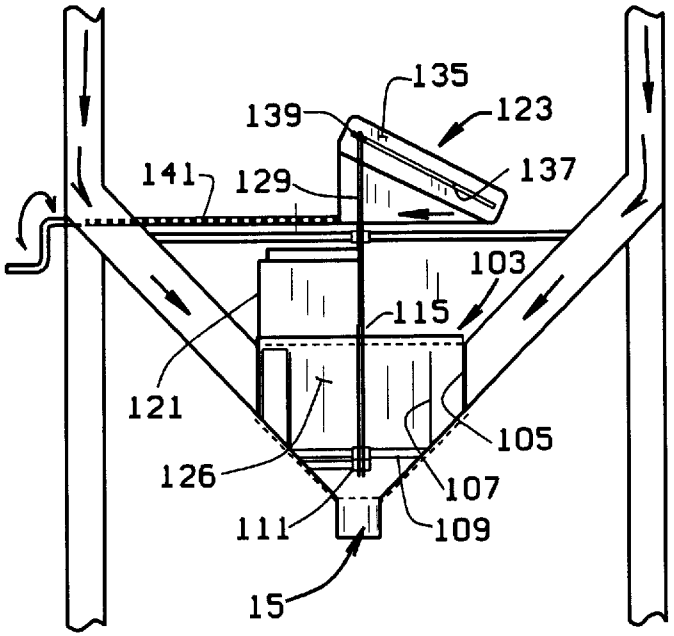
FIGS. 8A and 8B are, respectively, side elevational views of the unloader of FIG. 6 illustrating an unloader gate in a closed position (FIG. 8A) for blocking the flow of grain from the grain flow path to the unloader and a fully open position (FIG. 8B) in which grain is free to flow from the full height of the grain channels when a grain inlet opening in the outer wall of the unloader is in register with one of the grain channels, this unloader gate being movable to any selected position between its fully closed and its fully open position thereby to regulate the rate at which grain is unloader without the necessity of varying the rotational speed of the metering unloader.
Figure 8A:
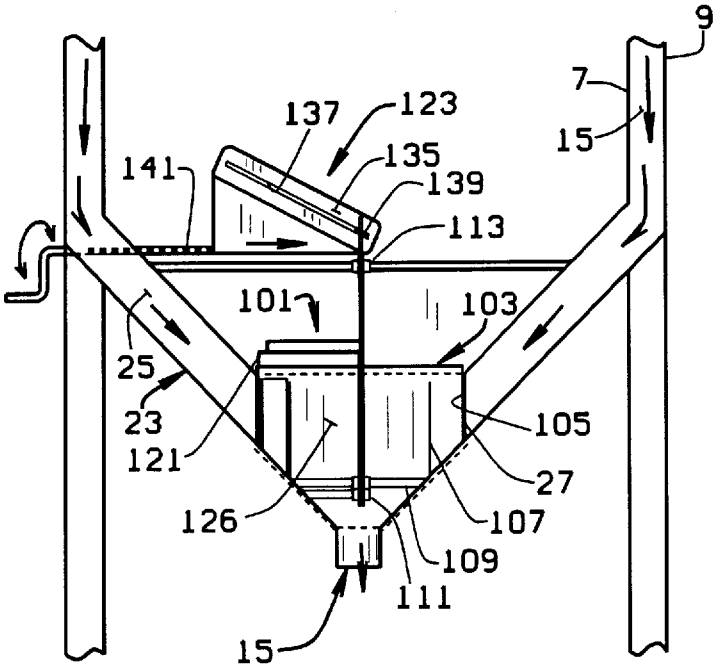

As shown in FIG. 7, outer cylindrical wall 105 of unloader body 103 has a grain inlet opening 119 therein at one location around the circumference of the unloader body. A vertically adjustable gate 121 is mounted within opening 119 and the gate is vertically movable by means of a gate operating mechanism, as generally indicated at 123, between a fully closed or lowered position (as shown in FIG. 8A) and a fully open (raised) position (as shown in FIG. 8B), or any desired position therebetween thereby to increase or to decrease the size (height) of grain inlet opening 119 and to thus regulate the flow of grain into the grain inlet opening without having to speed up or to slow down the rotational speed of unloader body 103. As noted, inner cylindric wall is spaced inwardly from outer cylindric wall 105 thus defining a grain space 125 therebetween. As shown in FIGS. 6–9, 12 and 14, unloader 101 has a plurality of dividers 126 spaced at substantially equal angular intervals around grain space 125 to divide the latter into compartments. It will be understood that dividers 126 are secured to the upper face of hopper 23 below unloader 101 and that the dividers do not rotate with the unloader, but rather remain stationary within grain space 125 as the unloader rotates. The inner wall has a grain opening 127 (as shown in FIG. 7) therein which allows grain in grain space 125 to fall by gravity toward the center of the unloader and to be discharged from the unloader via central grain outlet 15. As shown in FIG. 7, grain opening 127 in inner wall 107 is out of register (preferably 180° out of register) with opening 119 in outer wall 105 such that the grain or fluent material will not flow by gravity from opining 119 through chamber 125 to opening 127 without rotation of the unloader 101, as will hereinafter be described. It will be appreciated that additional openings may provided in outer wall 105 and additional opening may be provided in inner wall 107 so long as the spacing of the openings relative to one another is such that the fluent material will not flow by gravity from an opening in the outer wall through chamber 125 to an opening in the inner wall without rotation of the unloader.

Figure 5:
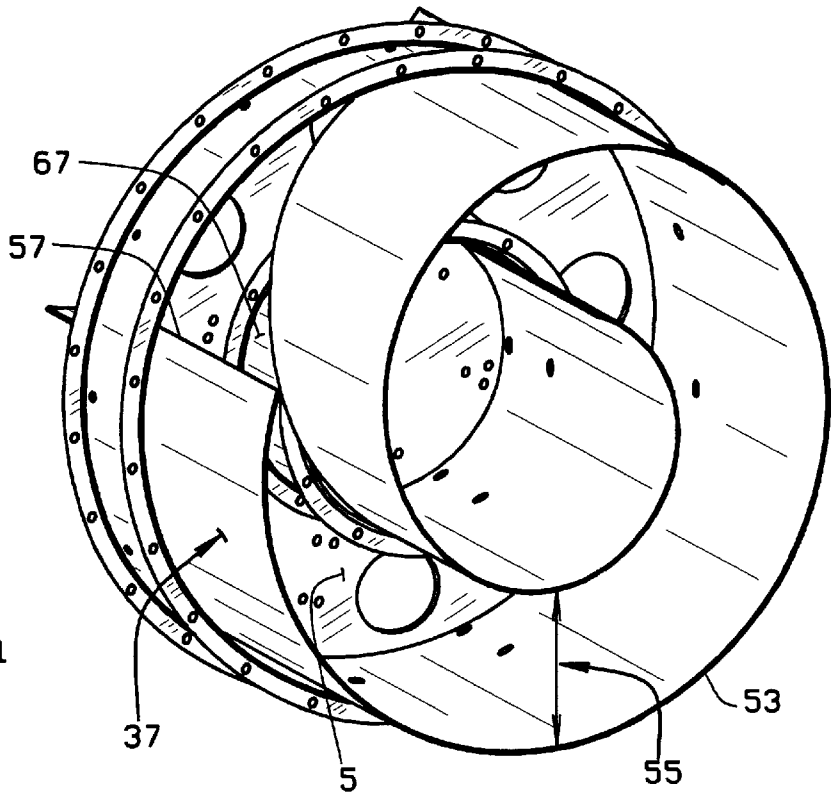
FIG. 5 is an end perspective view of the unloader body with the outer cylindrical wall removed so as to illustrate the spiral internal wall of the unloader which forms a spiral or involute shaped grain unloading path extending between a grain inlet opening within the unloader and a grain discharge outlet for the tower dryer.
Figure 4:
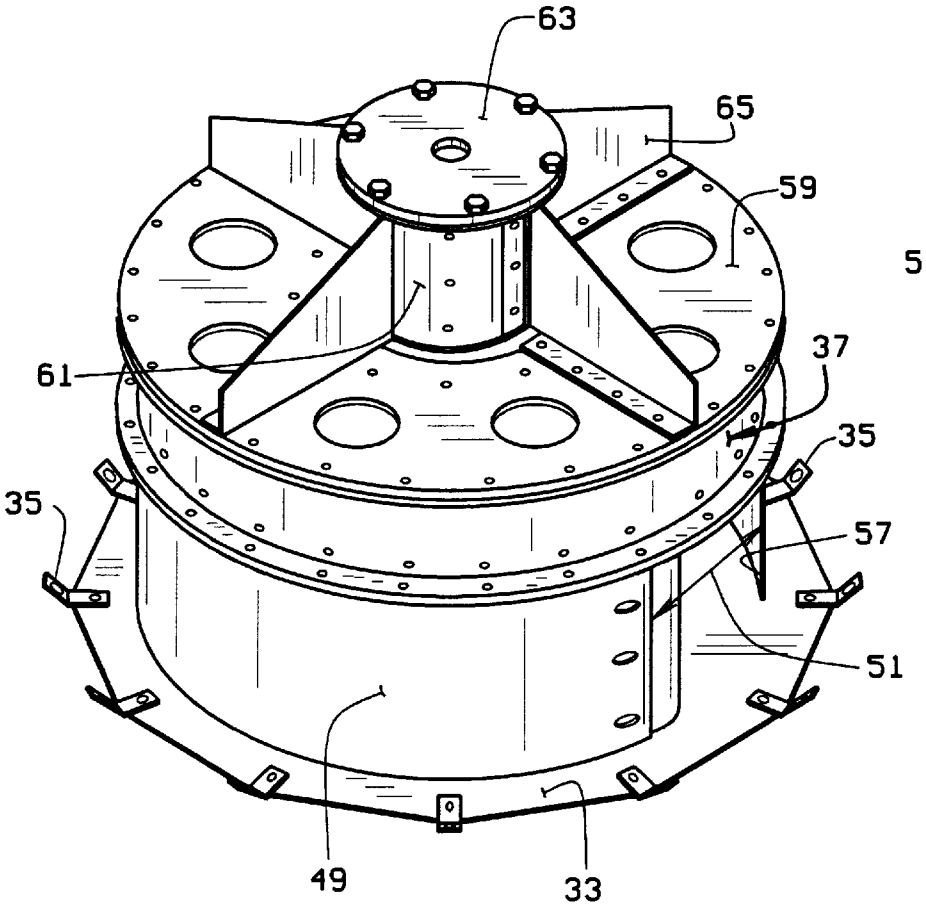
FIG. 4 is a perspective view of the unloader body on a somewhat larger scale than FIG. 3.

More specifically, in comparing unloader 101 to unloader 29, it will be noted that unloader 101 does not require the provision of a horizontal floor, such as bottom wall 33, but instead the lower end of hopper bottom 23 continues to slope downwardly and to converge on lower center grain discharge outlet 15. This, in turn, simplifies the construction of the lower end of the tower dryer because the horizontal floor and the support structure therefore need not be provided. Because the hopper bottom continues to slope downwardly toward grain discharge outlet 15 at the slope of the hopper (which slope is preferably substantially greater than the angle of repose of most grains and feed handled by tower dryer 1), this insures that the dried grain (or other material) entering unloader 101 will be reliably conveyed by gravity from grain inlet opening 119 in the outer wall 105 to grain outlet opening 127 in inner wall 107 thus eliminating the need for a mechanical sweep or the like for conveying the grain horizontally on a horizontal floor, such as the spiral arrangement for the unloader, as shown in FIG. 5. As shown, the lower edge of outer cylindric wall 105 is spaced just above the inner surface of the hopper bottom 23 and inner cylindric wall 107 extends down below the outer cylindric wall 105 and it is also spaced above the inner surface of hopper bottom 23.

Gate operating mechanism 123 is shown to comprise a shaft 129 disposed within and vertically slidable relative to hollow shaft 115. The upper region of hollow shaft 115 has a gate window 131 therein through which a gate mounting bracket 133 extends and which is secured (welded) to the inner shaft 129. The gate mounting bracket 133 extends from window 131 and it carries gate 121. The gate operating mechanism 123 further comprises a slide cam member 135 having an inclined cam slot 137 therein which is coupled to the upper end of shaft 129 by means of a cam follower bearing 139 mounted within cam slot 137. A screw jack 141 moves the slide cam member 135 radially inwardly and outwardly relative to shaft 129 and thus effects vertical movement of cam follower bearing 139 in cam slot 135. This, in turn, causes shaft 129 to rise or fall within hollow shaft 115 and thus the gate mounting bracket 133 rises and falls to thus raise or lower gate 121 relative to opening 119. Because shaft 129 is journalled in bearing 113 and because gate 121 rotates with unloader 103 the gate operating mechanism can raise or lower the gate without having to rotate with the unloader body. Of course, if the screw jack 141 is not moved, the gate 121 will remain fixed in a desired adjusted position. Those skilled in the art will recognize that mechanisms other than a screw jack may be used to effect movement of the gate.

Figure 10:
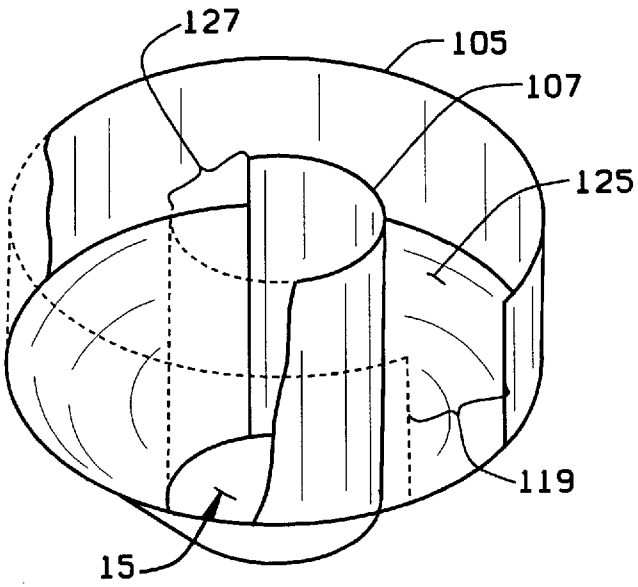
FIG. 10 is a view similar to FIG. 9 showing still another embodiment of the unloader which is similar to the unloader illustrated in FIG. 9 except that no dividers are provided between the inner and outer walls.
Figure 9:
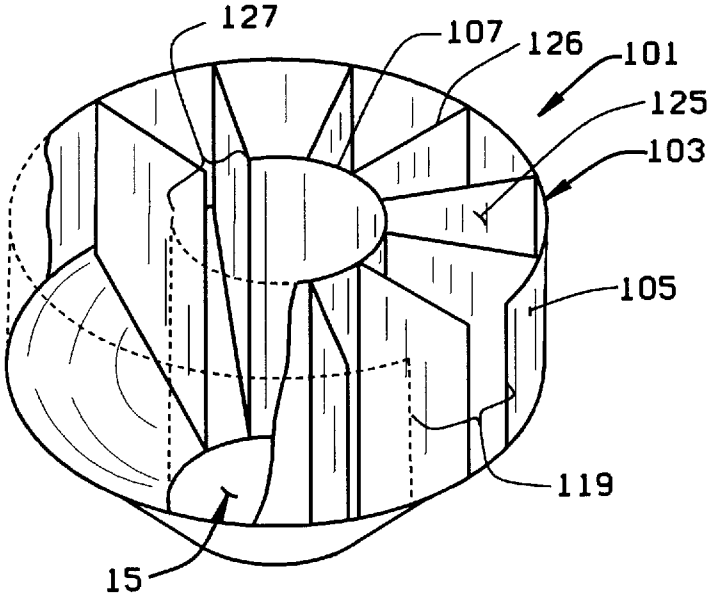
FIG. 9 is a perspective view of the unloader shown in FIG. 6 (with some parts broken away for clarity) showing the outer cylindric wall with an opening therein, an inner cylindric wall with a grain discharge opening, and with spaced dividers between the inner and outer walls dividing a grain chamber therebetween into sections.
Figure 11:
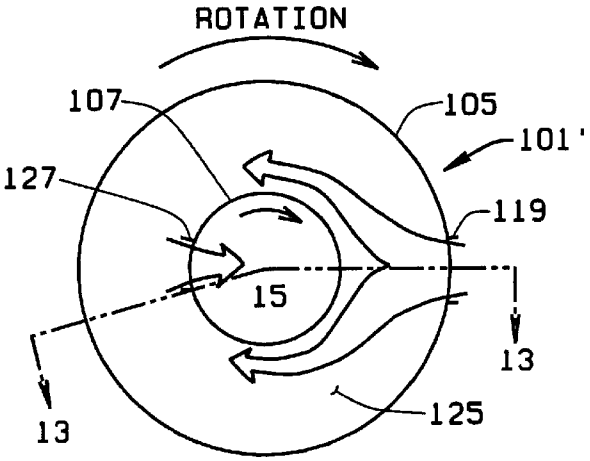
FIG. 11 is a diagrammatic view depicting the flow of grain from one of the grain outlets of a tower dryer into the unloader shown in FIG. 10 through the grain inlet opening in the outer wall of the unloader and further showing the flow of grain within the unloader to the grain discharge opening at the center of the unloader.
Figure 13:
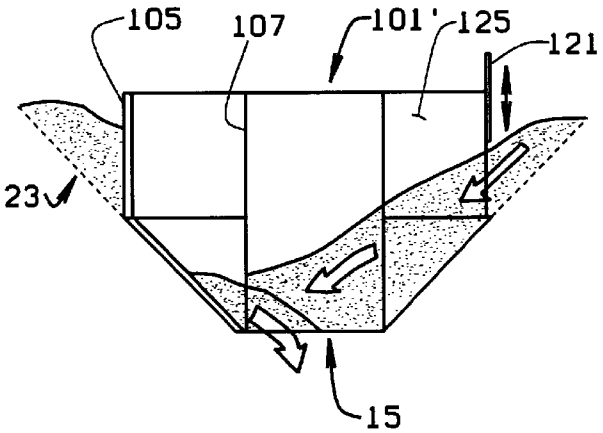
FIG. 13 is a cross sectional view taken along line 13—13 of FIG. 11 further illustrating the flow of the grain within the unloader.

A third embodiment of the unloader of this invention is shown in FIGS. 10, 11, and 13 and is generally indicated at 101'. This unloader 101' is similar in construction and operation to unloader 101 except that unloader 101' does not have the divider walls 126 within grain space 125.

Figure 12:
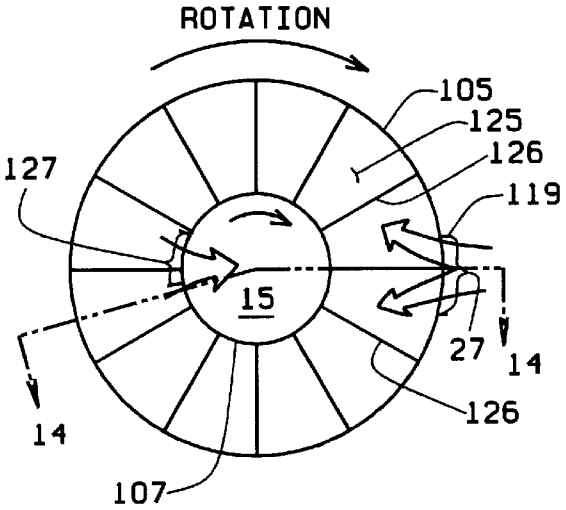
FIG. 12 is a view similar to FIG. 11 depicting the flow of grain from one of the grain outlets of a tower dryer into the unloader shown in FIG. 9 through the grain inlet opening in the outer wall of the unloader and further showing the flow of grain within the unloader around the dividers to the grain discharge opening at the center of the unloader.
Figure 14:
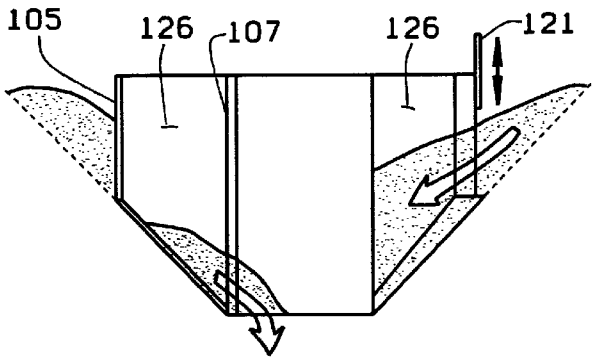
FIG. 14 is a cross sectional view taken along line 14—14 of FIG. 12 further showing the flow of the grain within the unloader.

In operation, with unloader body 101 rotatably driven at a constant speed by drive motor 117, the rate at which grain is unloaded from the grain column 9 of tower dryer 1 may be controlled or regulated by operating screw jack 141 so as to selectively raise or lower gate 121 within grain opening 119. With gate 121 raised and with opening 119 in register with one or more of the grain outlets 27, grain is discharged from the grain outlets at the lower ends of grain channels 25 and is free to flow by gravity from the grain channels into grain inlet opening 119 and into the portion of the grain space 125 between a pair of dividers 126 which are stationarily secured to hopper 23 and which are not rotatable with unloader body 103. It will be appreciated that grain is permitted to flow from one of the outlets 27 into annular space 125 between the outer and inner cylindric walls 105 and 107 of unloader body 103 when (and only when) opening 119 is in register with that grain outlet. The grain received between a pair of the stationary dividers 126 is held therein until the grain outlet 127 in inner wall 107 rotates into register with each of the grain compartments and thus allows the grain to flow by gravity from the grain compartment into grain discharge outlet 15. When the opening 119 is out of register with a grain compartment, the grain therein is held. Thus, on each revolution of unloader body 103 about vertical shaft 115, grain is free to be discharged from each of the grain outlets 27 only when each grain outlet in register with opening 119. The grain is then held in a respective grain chamber between adjacent dividers 126 until the grain outlet opening is in register with that compartment. The amount of grain that is discharged from each grain outlet 27 into grain inlet opening 119 on each revolution of the unloader may be selectively increased or decreased by raising or lowering gate 121 within opening 119 by actuation of screwjack 141. Of course, if gate 121 if fully lowered, the flow of grain into opening 119 may be fully blocked. The flow and holding of grain in unloader 101 is illustrated in FIGS. 12 and 14.

Figure 16:
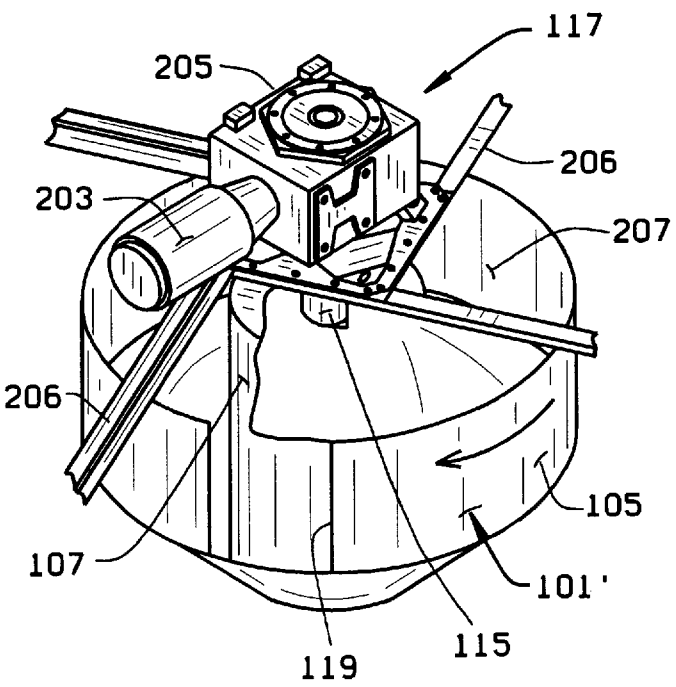
FIG. 16 is a view similar to FIG. 15 showing the unloader shown in FIGS. 10, 11 and 13.
Figure 15:
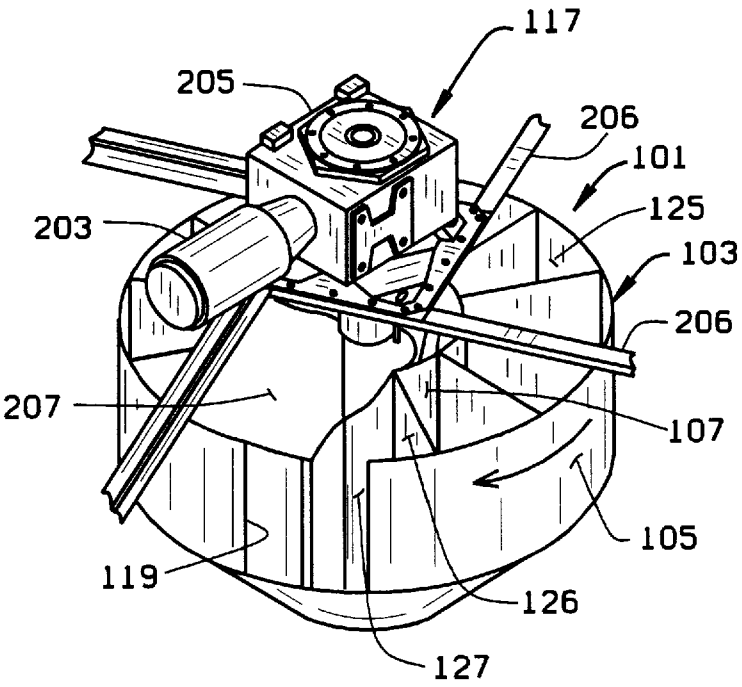
FIG. 15 is a perspective view of the unloader shown in FIGS. 6–9, 12, and 14 showing a frame for mounting the unloader with the lower hopper portion of a tower dryer and showing a constant speed drive motor and speed reducer for driving the unloader.

As heretofore described and as best shown in FIGS. 15 and 16, a drive, as generally indicated at 117, for unloaders 10 and 101' is shown. As noted, drive 117 is preferably a constant speed drive, as compared with the variable speed drive 41 described for use with unloader 29. Drive 117 comprises a drive motor 203 and a speed reducer 205. Drive 117 is mounted on an unloader frame 206 which in turn is structurally tied into the lower reaches of hopper bottom 23 so as to mount and support unloader 101 with respect to the hopper bottom with the unloader held in its desired position centered within the hopper and held in vertical position relative to grain discharge outlets 27. It will be appreciated that hollow shaft 115 extends into and through the hub of speed reducer 205 such that this hollow shaft is driven by the speed reducer so as to rotate unloader 101 or 101'. It will be further understood that both unloader 101 and 101' have a cover plate 207, similar to cover plate 59, overlying the upper edges of cylindric walls 105 and 107 such that the wall are supported by cover plate 207 and such that as the cover plate is rotatably driven by drive 117 that the inner and outer walls of unloaders 101 and 101' are rotatably driven. As further shown, a frame 209 is provided for supporting drive 117 relative to the inside of the hopper of tower dryer 1. Still further, it will be understood that the inner shaft 129 housed within hollow shaft 115 extends through and above speed reducer 205 and that the gate operating mechanism 123 shown in FIGS. 6, is mounted above drive 117. However, the gate operating mechanism is not shown in FIGS. 15 and 16 for purposes of clarity.

As shown in FIGS. 10, 11 and 13, a variation of unloader 101 is indicated in its entirety by reference character 101'. More specifically, unloader 101' is similar to unloader 101 except that it does not have stationary dividers which divide grain space 125 into chambers. The flow of grain into grain space 125 of unloader 101' is shown in FIGS. 11 and 13. Of course, unloader 101 operates in a manner similar to unloader 101 above-described.

It will be appreciated that the unloaders described herein (i.e., unloaders 29, 101 and 101') are all metering unloaders. That is, on each revolution of the unloader about its vertical axis, its respective grain opening 51 or 119, moves past all of the grain discharge outlets 27 of grain path 11 in the hopper section of the grain column of the tower dryer so as to have a quantity of grain unloaded from each of the grain discharge outlets 27 each time the grain opening moves therepast. This insures that a uniform amount of grain will be unloaded or metered from each of the grain outlets on each revolution of the unloader and thus in turn insures that all portions of the grain column in the tower dryer moves through the dryer at substantially the same rate or speed to in turn insure that all regions of the grain column are uniformly dried or conditioned.

It will be appreciated that the quantity of grain metered into the unloader of this invention may be controlled in a variety of manners. With regard to unloader 29 shown in FIGS. 1–6, the rate at which grain is metered into unloader 29 is controlled by varying the speed at which unloader is rotated. This is accomplished by providing a variable speed drive 41. In contrast, the rate at which grain is metered into unloaders 101 or 101' is controlled by the degree that gate 121 is opened relative to grain inlet opening 119 in outer wall 105. Of course, if gate 121 is closed, no grain will be removed from grain channels 27, and if gate 121 is fully opened, the maximum amount of grain will be removed from each of the grain channels on each revolution of the unloader.

However, with regard to unloaders 29, 101, and 101', there is still another variation of controlling the rate at which grain is unloaded from the grain column of the tower dryer 1. That is, by intermittently initiating operation of the unloader drive motor 41 or 203, an average rate of grain removal may be controlled without requiring a variable speed drive or without requiring a gate 121 or a gate operating mechanism 123. For example, if an operator would want to operate the unloader to unload so as to unload grain from tower dryer 1 at one half of the maximum unload rate for either unloader 29 (assuming that the variable speed drive motor 41 is operated at its maximum speed) or unloader 101, the operator (or the controller 21 for the dryer) would only operate the drive motor 41 or 203 for one half of the time and the drive would not be operated for the one half of the time. O course, other relations of the on/off time could be employed, depending on the average rate at which grain is to be unloaded. If grain is to be unloaded at a rate in a given time of only 10% of the maximum unloading rate for the unloader, the unloader need only be operated for 10% of the time of a given period. More specifically, if the period for the unloader is 5 minutes (300 seconds), in each 5 minute period, the unloader need only be operated for 30 seconds. Thus, on average, grain would be removed at one half of its maximum unloading rate. Preferably, the dryer would be operated on an on/off duty cycle using, in effect, a pulse width modulation control strategy where the drive would be operated intermittently, but the grain would move through the dryer in a substantially uniform manner such that the grain would be sufficiently dried, but would not be damaged by being subjected to the hot drying air for extended periods of time.

It will also be appreciated that using such an unloader, as described herein, tower dryer T can effectively be operated as either a continuous flow dryer or as a batch dryer. If the dryer is to be operated as a continuous flow dryer, the variable speed drive motor 41 for unloader 29 can be set to unload a desired quantity of grain/hour of operation, or gate 121 can be opened a desired amount such that when the constant speed drive for unloader 101 or 101' is operated at its fixed speed, the desired quantity of grain can be unloaded in a given length of time, or drive 41 or drive 117 can be intermittently operated so as of unload this desired quantity of grain.

If dryer T is operated as a batch dryer, starting with tower T filled with grain, as shown in FIG. 1, the unloader of this invention (e.g., unloader 29, 101) is operated so as to unload a predetermined quantity (batch) of grain from the grain path 11 via outlet 15. As a batch of grain is unloaded from the dryer, all of the grain in the grain path 11 moves down in the tower, and another batch of grain to be dried may be loaded into the top to tower T. In this manner, batches of grain are sequentially moved through the entire length of the grain path and each batch remains in each region of the grain path such that all of the grain will be properly dried and such that none of the grain will be unduly dried or damaged by excess heat or the like, and such that all of the grain will be cooled sufficiently by cooling air entering the tower (as shown by the arrows in FIG. 1).

While the unloaders of this invention have herein been described in the context of a tower dryer, as shown in FIG. 1, for unloading dried grain from the tower dryer T, it will be appreciated that the unloaders of this invention may have various other uses. For example, the unloader need not be used to unload grain from a flow path, such unloading grain, animal feed, or other fluent material from a bin or a tank or the like where it is desired that a quantity of the fluent material be unloaded in a controlled or metered fashion instead of depending on the flow characteristics of the fluent material to effect the desired unloading. Further, the term "fluent material" is herein defined to refer to any flowable material which is preferably a dry or moist solid, whether it be of a granular, powdered, or other flowable consistency. Examples of such fluent material include grain, animal and poultry feeds, grain meals, plastic pellets, cement, and other such materials.

It can be seen that the detailed description of the preferred forms and embodiments of the invention fulfill the objects and advantages set forth above. Inasmuch as numerous modifications may be made to the preferred embodiments without departing from the spirit and scope of the invention, the scope of the invention is to be determined by the scope of the following claims.

We claim:

1. A metering unloader (29, 101) for unloading a fluent material from a generally vertical flow path (11) with said unloader at the lower reaches of said flow path, said flow path having a plurality of fluent material outlets (27) disposed around said unloader, said metering unloader comprising an unloader body (37, 103) having an outer wall (49, 105) defining a chamber (55, 126) therewithin, said chamber having a fluent material discharge outlet (15) in communication therewith, a drive (41, 117) for rotating said unloader body about a vertical axis, a fluent material inlet opening (51,119) in said outer wall (49, 105) so that upon rotation of said unloader body said fluent material inlet opening (51, 119) moves into and out of register with each of said flow path fluent material outlets (27) such that said fluent material will flow by gravity through said fluent material inlet opening (51, 119) in said outer wall into said chamber (55, 126) and such that said fluent material in said chamber (55, 126) may flow by gravity from said chamber to said fluent material discharge outlet (15), and a control (121) for regulating the flow of said fluent material into said material inlet opening (51, 119) from each of said fluent material outlets (27) thereby to unload a desired volume of said fluent material upon each revolution of said unloader.

2. A metering unloader as set forth in claim 1 wherein said control is a gate (121) mounted relative to said fluent material inlet opening (119) in said outer wall, and means (123) for opening and closing said gate (119) thereby to regulate the flow of fluent material through said material inlet opening (119) into said chamber (126) from said one or more fluent material outlets (27) when said fluent material inlet opening (119) is in register therewith and to vary the rate at which said unloader unloads said fluent material from said flow path.

3. A metering unloader (29, 101) for unloading a fluent material from a generally vertical flow path (11) substantially surrounding said unloader, said flow path having a plurality of fluent material outlets (27) in communication with said unloader, said metering unloader comprising an unloader body (37, 103) having an outer cylindric wall (49, 105) and an inner cylindric wall (52,107) spaced radially inwardly from said outer wall with said walls defining a chamber (55, 126) therebetween, means (41, 117) for rotating said unloader body about a vertical axis, a fluent material inlet opening (51,119) in said outer wall (49, 105) such that with said fluent material inlet opening (51, 119) in register with said fluent material outlets (27) said fluent material will flow by gravity through said fluent material inlet opening in said outer wall into said chamber (55, 126), said inner wall (52, 107) having a fluent material outlet opening (56, 127) therein such that said fluent material in said chamber (55, 126) may flow by gravity from said chamber to a fluent material discharge outlet (15), and means for regulating (121) the rate at which grain is uniformly metered from said fluent material outlets (27) thereby to discharge a desired volume of said fluent material in a given length of time.

4. A metering unloader as set forth in claim 3 wherein said regulating means is a variable speed drive (41) for said unloader (29, 101).

5. A metering unloader as set forth in claim 3 wherein said regulating means is a gate (121) mounted relative to said fluent material inlet opening (119) in said outer wall, and means (123) for opening and closing said gate (119) thereby to regulate the flow of fluent material into said chamber (126) from said one or more fluent material outlets (27) when said fluent material inlet opening (119) is in register therewith and to vary the rate at which said unloader unloads said fluent material from said flow path.

6. A metering unloader as set forth in claim 3 wherein said regulating means is a controller (21) programmed to intermittently operate and stop said unloader such that over a predetermined time, said unloader unloads a predetermined amount of fluent material from said flow path.

7. A metering unloader (101) for unloading a fluent material from a generally vertical, annular flow path (11), said flow path having a plurality of fluent material outlets (27) at its lower end, said metering unloader comprising an unloader body (103) having an outer wall (105) defining a chamber (126) therewithin, said plurality of material outlets (27) surrounding said outer cylindric wall of said unloader, means (117) for rotating said unloader body about a vertical axis, a fluent material inlet opening (119) in said outer wall (105) such that with said fluent material inlet opening (119) in register with one of said flow path fluent material outlets (27) said fluent material will flow by gravity from said one fluent material outlet through said fluent material inlet opening (119) in said outer wall into said chamber (126), a fluent material outlet opening (127) in communication with said chamber such that said fluent material in said chamber (126) may flow by gravity from said chamber to a fluent material discharge outlet (15), a gate (121) mounted relative to said fluent material inlet opening (119) in said outer wall, and means (123) for opening and closing said gate (119) thereby to regulate the flow of fluent material into said chamber (126) from said fluent material outlet (27) when said fluent material inlet opening (119) is in register therewith and to vary the amount of said fluent material entering said material inlet opening (119) upon said material inlet opening rotating past each of said fluent material outlets (27) upon each revolution of said unloader and to thus regulate the rate at which said unloader unloads said fluent material from said flow path.

8. A metering unloader for a tower grain dryer, said tower dryer comprising a vertical tower having a plenum therein, said plenum having a plenum wall, said tower having an outer wall surrounding said plenum wall and being spaced outwardly therefrom for forming a grain drying path between said tower outer wall and said plenum wall, said grain to be dried being conveyed through said grain drying path generally from the top to the bottom of said dryer, said outer wall of said tower and said plenum wall being porous to permit air to flow therethrough, said tower dryer having means for moving air into said plenum, through said plenum wall, through said grain in said grain drying flow path thereby to dry said grain, and through said tower wall to exhaust said air to the atmosphere on the exterior of said outer tower wall, said grain drying path having a plurality of grain outlets at the lower end thereof, said tower having at least one discharge outlet in the lower portion thereof, said metering unloader having an outer wall spaced radially inwardly of said grain outlets and being rotatably mounted within the lower portion of said tower for rotation about a vertical axis, means for rotatably driving said metering unloader about said vertical axis, said metering unloader having an opening in said outer wall for receiving grain from said grain outlets as said metering unloader is rotated about said vertical axis, and a gate disposed relative to said opening in said outer wall for regulating the amount of grain received in said opening as said unloader body is rotated about said vertical axis so as to substantially uniformly remove dried grain from all of said grain outlets upon each revolution of said metering unloader and for the delivery of such dried grain to said at least one discharge outlet.

9. A metering unloader for a tower dryer as set forth in claim 8 wherein said metering unloader has an inner wall spaced from said outer wall and defining a grain space therebetween, said inner wall have a grain discharge opening therein such that grain within said grain space is free to flow from said grain space to said discharge outlet.

10. A metering unloader for a tower dryer as set forth in claim 9 wherein further comprising means for adjusting said gate relative to said opening in said outer wall for regulating the amount of grain received opening as said opening rotates past each of said grain outlets.

11. A metering unloader for a tower dryer as set forth in claim 10 wherein said gate adjusting means comprises a vertical shaft generally coaxial with said vertical axis of rotation of said unloader, said vertical shaft having said gate coupled thereto, and said gate adjusting means including means for vertically moving said vertical shaft up and down relative to said unloader thereby to move said gate relative to said opening and to thus regulate the size of said opening.

12. A metering unloader for a tower dryer as set forth in claim 11 wherein said gate adjusting means comprises a cam member movable radially inwardly and outwardly relative to said vertical axis about which said unloader is rotated, said cam member having a cam surface, said vertical shaft being coupled to said cam surface of said cam member by a cam follower such that as said cam member is moved radially inwardly and outwardly said vertical shaft and said gate is moved vertically relative to said gate.

13. A metering unloader for a tower dryer as set forth in claim 12 wherein said cam member is moved radially inwardly and outwardly by means of a screw jack.

14. A metering unloader for a tower dryer as set forth in claim 13 wherein said screw jack extends exteriorily of said tower and is operable from the outside of the tower so as to enable an operator to selectively raise or lower said gate relative to said opening thereby to vary the amount of grain unloaded.

* * * * *